US007021087B2

(12) United States Patent
France et al.

(10) Patent No.: US 7,021,087 B2
(45) Date of Patent: Apr. 4, 2006

(54) METHODS AND APPARATUS FOR APPLYING A TREATMENT FLUID TO FABRICS

(75) Inventors: Paul Amaat Raymond Gerald France, West Chester, OH (US); Linda Carol McWilliams, Cincinnati, OH (US); Thomas Brian Norris, Milford, OH (US); Michael Jason Ullom, Mason, OH (US)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/932,866

(22) Filed: Sep. 2, 2004

(65) Prior Publication Data

US 2005/0166644 A1 Aug. 4, 2005

Related U.S. Application Data

(60) Continuation-in-part of application No. 10/738,551, filed on Dec. 17, 2003, now Pat. No. 6,898,951, and a division of application No. 10/307,884, filed on Dec. 2, 2002, now Pat. No. 6,811,811, which is a continuation of application No. PCT/US02/25888, filed on Aug. 14, 2002, which is a continuation of application No. 09/849,893, filed on May 4, 2001, now Pat. No. 6,691,536.

(60) Provisional application No. 60/312,625, filed on Aug. 15, 2001, provisional application No. 60/209,468, filed on Jun. 5, 2000.

(51) Int. Cl.
*D06F 39/08* (2006.01)

(52) U.S. Cl. ..... 68/17 R; 68/58; 68/142; 68/207; 68/205 R

(58) Field of Classification Search ..... 68/24, 68/58, 142, 207, 200, 205 R, 152, 153, 17 R
See application file for complete search history.

(56) References Cited

U.S. PATENT DOCUMENTS

| | | | | |
|---|---|---|---|---|
| 1,832,560 | A * | 11/1931 | Kendig | 8/137 |
| 2,400,726 | A * | 5/1946 | Wright et al. | 118/52 |
| 2,434,476 | A * | 1/1948 | Wales | 68/19.2 |
| 2,846,776 | A * | 8/1958 | Clark | 34/547 |
| 2,958,954 | A * | 11/1960 | Longenecker | 34/527 |
| 3,002,288 | A | 10/1961 | Conlee et al. | |
| 3,103,450 | A * | 9/1963 | Janson | 68/5 C |
| 3,401,052 | A * | 9/1968 | Berger et al. | 427/242 |
| 4,102,824 | A | 7/1978 | Mizutani et al. | |
| 4,111,645 | A * | 9/1978 | Zurbuchen et al. | 8/614 |
| 4,207,683 | A * | 6/1980 | Horton | 34/60 |
| 4,236,320 | A * | 12/1980 | Schwadike et al. | 34/428 |

(Continued)

FOREIGN PATENT DOCUMENTS

DE 37 39 711 A1 6/1989

(Continued)

OTHER PUBLICATIONS

Eurpoean Patent Office 0 536 542, Sep./1992.*

(Continued)

*Primary Examiner*—Frankie L. Stinson
(74) *Attorney, Agent, or Firm*—Caroline Wei-Berk; Kim W. Zerby; Steven W. Miller

(57) ABSTRACT

The present invention relates to methods and/or systems for applying treatment fluid to a plurality of fabric articles in a fabric treatment apparatus. The present invention is also directed to an apparatus capable of carrying out such methods and/or systems.

15 Claims, 1 Drawing Sheet

U.S. PATENT DOCUMENTS

| | | | | |
|---|---|---|---|---|
| 4,639,321 | A | | 1/1987 | Barrat et al. |
| 4,685,930 | A | | 8/1987 | Kasprzak et al. |
| 4,708,807 | A | | 11/1987 | Kemerer et al. |
| 5,057,240 | A | | 10/1991 | Madore et al. |
| 5,457,970 | A | * | 10/1995 | Gutkin ..... 68/23.5 |
| 5,461,742 | A | | 10/1995 | Pasad et al. |
| 5,595,071 | A | * | 1/1997 | Pasad et al. ..... 68/5 C |
| 5,705,562 | A | | 1/1998 | Hill et al. |
| 5,707,613 | A | | 1/1998 | Hill et al. |
| 5,865,852 | A | | 2/1999 | Berndt et al. |
| 5,876,510 | A | | 3/1999 | Kuemin et al. |
| 5,888,250 | A | | 3/1999 | Hayday et al. |
| 5,942,007 | A | | 8/1999 | Berndt et al. |
| 5,977,040 | A | | 11/1999 | Inada et al. |
| 5,985,810 | A | | 11/1999 | Inada et al. |
| 6,013,683 | A | | 1/2000 | Hill et al. |
| 6,042,617 | A | | 3/2000 | Berndt et al. |
| 6,042,618 | A | | 3/2000 | Berndt et al. |
| 6,056,789 | A | | 5/2000 | Berndt et al. |
| 6,059,845 | A | | 5/2000 | Berndt et al. |
| 6,060,546 | A | | 5/2000 | Powell et al. |
| 6,063,135 | A | | 5/2000 | Berndt et al. |
| 6,136,766 | A | | 10/2000 | Inada et al. |
| 6,156,074 | A | | 12/2000 | Hayday et al. |
| 6,177,399 | B1 | | 1/2001 | Mei et al. |
| 6,258,130 | B1 | | 7/2001 | Murphy et al. |
| 6,273,919 | B1 | | 8/2001 | Hayday et al. |
| 6,309,425 | B1 | | 10/2001 | Murphy et al. |
| 6,310,029 | B1 | | 10/2001 | Kilgour et al. |
| 6,313,079 | B1 | | 11/2001 | Murphy et al. |
| 6,368,359 | B1 | | 4/2002 | Perry et al. |
| 2001/0020308 | A1 | | 9/2001 | Murphy et al. |
| 2001/0034912 | A1 | | 11/2001 | Kilgour et al. |
| 2002/0004953 | A1 | | 1/2002 | Perry et al. |
| 2002/0115582 | A1 | | 8/2002 | Perry et al. |
| 2002/0174493 | A1 | | 11/2002 | Perry et al. |

FOREIGN PATENT DOCUMENTS

| | | | | |
|---|---|---|---|---|
| EP | 0982 023 | A2 | | 3/2000 |
| EP | 1 041 189 | A1 | | 10/2000 |
| EP | 1 043 443 | A1 | | 10/2000 |
| EP | 1092 803 | A1 | | 4/2001 |
| GB | 1130942 | | | 10/1968 |
| JP | 4-135599 | | * | 5/1992 |
| JP | 2000-290689 | | | 10/2000 |
| WO | WO 00/04221 | | | 1/2000 |
| WO | WO 00/04222 | | | 1/2000 |
| WO | WO 00/63340 | | | 10/2000 |
| WO | WO 01/40567 | A1 | | 6/2001 |
| WO | WO 01/94678 | A1 | | 12/2001 |
| WO | WO 01/94681 | A1 | | 12/2001 |
| WO | WO 01/94684 | A1 | | 12/2001 |
| WO | WO 02/97024 | | | 5/2002 |
| WO | WO 02/46517 | A1 | | 6/2002 |
| WO | WO 02/48447 | A1 | | 6/2002 |
| WO | WO 02/50366 | A1 | | 6/2002 |
| WO | WO 02/277356 | A1 | | 10/2002 |

OTHER PUBLICATIONS

European Patent Office 0 552 843, Jan./1993.*

* cited by examiner

METHODS AND APPARATUS FOR APPLYING A TREATMENT FLUID TO FABRICS

RELATED APPLICATIONS

This application is a divisional of prior co-pending U.S. patent application Ser. No. 10/307,884, filed Dec. 2, 2002 now U.S. Pat. No. 6,811,811; which is a continuation application of prior co-pending International Application No. PCT/US02/25888, filed Aug. 14, 2002; which claims priority to U.S. Provisional Application Ser. No. 60/312,625, filed Aug. 15, 2001; and is a continuation-in-part of U.S. patent application Ser. No. 10/738,551, filed Dec. 17, 2003 now U.S. Pat. No. 6,898,951; which is a continuation of U.S. application Ser. No. 09/849,893, filed on May 4, 2001, now U.S. Pat. No. 6,691,536; which claims priority under 35 USC 119(e) to U.S. Provisional Application Ser. No. 60/209,468 filed on Jun. 5, 2000.

FIELD OF THE INVENTION

The present invention relates to methods and/or systems for applying treatment fluid to a plurality of fabric articles in a fabric treatment apparatus. The present invention is also directed to an apparatus capable of carrying out such methods and/or systems.

BACKGROUND OF THE INVENTION

In recent times, consumers have demanded more in the form of deliverables from both conventional laundry and dry cleaning practices. Further, consumers and commercial service providers prefer that these benefits be delivered within one apparatus to minimize additional labor or effort. Examples of the desired deliverables include fabric treatment for durability, resilience, waterproofing, stainproofing, aesthetics, perfume application, improved cleaning, improved whitening, and wrinkle reduction/release.

Most of these deliverables require even or semi-even distribution of low fluid volumes onto the fabric surfaces due to cost or efficacy considerations. Perfume, for example, requires semi-even distribution. In other words, it is not desirable for a fabric article to be drenched in perfume while another fabric article receives one drop in one area. Waterproofing, on the other hand, requires even distribution. In other words, it is desirable that a fabric article or several fabric articles are almost entirely covered across their surface(s) such that the water resistance is not blotchy across the article.

Conventional aqueous-based laundering and dry cleaning apparatuses typically introduce an aqueous liquor or cleaning fluid, respectively, by way of one or more spouts positioned at or near the top of the chamber, above the area the fabric load normally resides while in the chamber. Spray devices are rarely utilized. The cleaning fluid, in the case of dry cleaning apparatuses, or aqueous liquor, in the case of conventional laundering apparatuses, flows out of at least one spout falling onto or near the fabric load. Most, if not all of the time, this cleaning bath continues to flow until the fabric load is immersed wherein every article within the fabric load is in a state far above its absorptive capacity.

Complete immersion is an effective way to deliver cleaning baths made up of adjunct ingredients and water or cleaning fluids; however, as alluded to above, many of the recently-demanded deliverables require distribution of low fluid volumes onto the fabric surface in order to be effective or economically feasible. As a result, complete immersion may not be an effective or cost conscious way to deliver many consumer noticeable benefits. Further, while application of low fluid volumes may be achieved with controlled flow devices, point saturation and uneven distribution across the fabric load are still problematic, particularly when some fabric articles lay directly before the controlled flow device blocking the path to other fabric articles.

Accordingly, the need remains for an economically feasible and/or effective way to apply treatment fluid onto the surfaces of the fabrics for the purpose of delivering consumer noticeable benefits without the negative effects of point saturation and uneven treatment fluid distribution.

SUMMARY OF THE INVENTION

This need is met by the present invention wherein a method for economically and/or effectively applying fabric treatment fluid onto the surfaces of fabrics for the purpose of delivering consumer noticeable benefits without the negative effects of point saturation and uneven treatment fluid distribution.

In general, the invention encompasses contacting a plurality of fabric articles contained within a fabric-containing chamber of a fabric treating apparatus while the plurality of fabric articles are in motion.

In a first aspect of the invention, a method for treating a plurality of fabric articles contained within a chamber of a fabric treatment apparatus comprising the step of contacting the plurality of fabric articles with a fabric treatment fluid while the plurality of fabric articles are in motion such that the plurality of fabric articles are treated, is provided.

In a second aspect of the present invention, a fabric treating system comprising:

a. a chamber for receiving a plurality of fabric articles to be treated;

b. a motion provider associated with said chamber for providing motion to the plurality of fabric articles when contained within said chamber;

c. an applicator associated with said chamber for applying a fabric treatment fluid to said plurality of fabric articles when contained within said chamber;

wherein said motion provider and said applicator are in communication such that said applicator applies the fabric treatment fluid to the plurality of fabric articles only when the plurality of fabric articles are in motion, is provided.

In yet another aspect of the present invention, a fabric treating apparatus comprising:

a. a chamber for receiving a plurality of fabric articles to be treated;

b. a motion provider mechanically associated with said chamber such that it is capable of providing rotational motion to said chamber;

c. an applicator mechanically associated with said chamber for applying a fabric treatment fluid into said chamber wherein said motion provider and said applicator are in communication such that said applicator applies the fabric treatment fluid into said chamber only when said chamber is in motion, is provided.

Accordingly, the present invention provides fabric treating methods and systems and an apparatus for use in such methods and/or systems.

These and other aspects, features and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All measurements are in SI units unless otherwise specified. All documents, books, articles, and references cited are, in relevant part, incorporated herein by reference.

DETAILED DESCRIPTION OF THE INVENTION

Definitions

Figure 1:
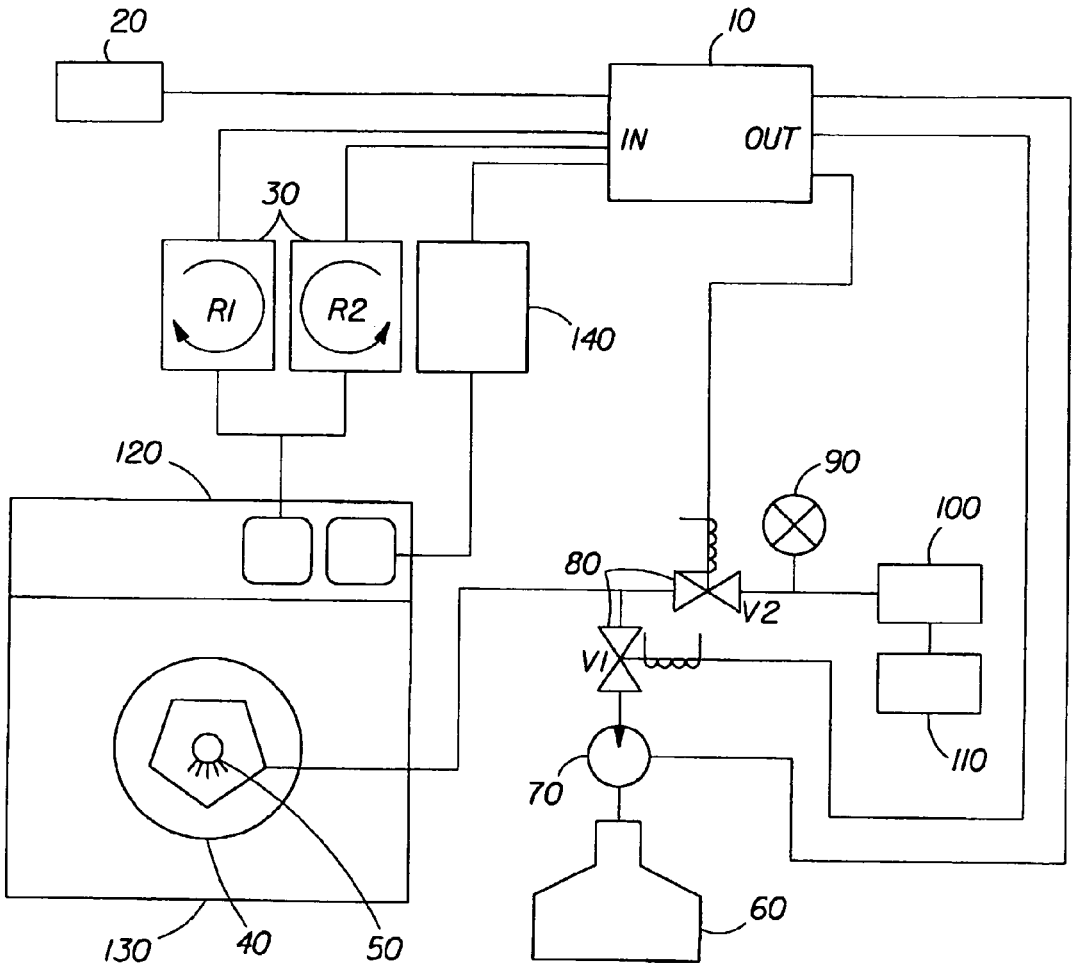
FIG. 1 is a schematic representation of a programmable logic controller can be utilized to carry out the application methods of the instant invention.

The terms "fabrics," "fabric articles," and "fabric load" used herein is intended to mean any article or group of articles that is customarily cleaned in a conventional laundry process or in a dry cleaning process. As such the term encompasses articles of clothing, linen, drapery, and clothing accessories. The term also encompasses other items made in whole or in part of fabric, such as tote bags, furniture covers, tarpaulins and the like.

The term "lipophilic fluid" used herein is intended to mean any non-aqueous fluid capable of removing sebum, as qualified by the test described herein.

The terms "treatment fluids," "adjuncts," and "adjunct ingredients," encompasses, at minimum, one of the constituents selected from surfactants, bleaches, durability agents, resiliency agents, waterproofing agents, stainproofing agents, visual aesthetic enhancers, fragrance enhancers, cleaning agents, whitening agents, and wrinkle reduction/release agents, and the like. These adjuncts and others are also described in more detail herein.

The term "motion provider" used herein encompasses motors that are connected to the fabric article-receiving chamber to provide motion, preferably rotational motion to the chamber as well as other means of providing motion to the plurality of fabric articles when present in the chamber. Nonlimiting examples of these other means include gases applied into the chamber to cause the plurality of fabric articles to move and/or tumble, mixers, agitators, and other mechanical hardware that can extend into the fabric article-containing chamber to cause movement of the fabric articles.

Application of Fabric Treatment Fluid

Utilization of spray applicators is a preferred way to practice the application methods of the present invention. Spray technology including spray qualities and nozzle types is well described in the reference *Atomization and Sprays,* by A. H. Lefebvre, Hemisphere Publishing Company, USA, 1989. There are many ways to apply the treatment fluids via spray applicators in accordance with the present invention.

Sprays vary in pattern, penetration length, shape, and droplet size among others. Two of the preferred shapes for sprays include solid cone and hollow cone spray patterns. A solid cone spray is one wherein the droplets are fairly uniformly distributed throughout a solid conical spray volume. A hollow cone spray is one wherein the droplets are concentrated at the outer edge of a conical spray pattern. A fan spray or flat spray or flat fan spray is one that is in the shape of a sector of a circle of about a 75-degree angle and is elliptical in cross section. A flat fan spray is not a preferred spray shape for purposes of the instant invention.

There are also many variations in the operation of the systems used to create a spray. Atomization is the process whereby a volume of liquid is disintegrated into a multiplicity of small drops and there are many devices available for the creation of sprays, all of which are suitable for use with the instant invention. A pressure atomizer is a single-fluid atomizer in which the conversion of pressure into kinetic energy results in a high relative velocity between the liquid and the surrounding gas. A plain-orifice atomizer is one wherein liquid is ejected at a high velocity through a small round hole; a widely familiar example is a diesel injector. An ultrasonic atomizer is one wherein a vibrating surface is used to cause a liquid film to become unstable and disintegrate into drops. A whistle atomizer is one wherein sound waves are used to shatter a liquid jet into droplets.

A gas-assist nozzle is one wherein high-velocity gas or steam is used to enhance pressure atomization at low liquid flow rates. A gas-blast atomizer is one wherein a liquid jet or sheet is exposed to a gas flowing at high velocity. The main difference between the two systems lies in the quantity of gas employed and its atomizing velocity. In the case of the gas-assist nozzle, the gas is supplied from a compressor or a high-pressure cylinder; and, it is important to keep the gas flow rate at a minimum. However, there is no restriction on gas pressure; thus, the atomizing gas velocity can be very high. In sum, gas-assist atomizers are characterized by their use of relatively small quantities of very high velocity gas. One variation is an external mixing nozzle; it is a gas-assist atomizer in which high-velocity gas impinges on a liquid at or outside the final orifice. Examples of gases that can be used in all gas assist nozzles include air, nitrogen, steam, and combinations thereof. Of course, the gas or combination gas may contain contaminants including other gases.

Other spray parameters include those involving spray droplet size and distribution as well as spray flow parameters. A polydisperse spray is one containing drops of different sizes and can exist in any spray shape. A spray droplet's size is typically expressed as the diameter of a spherical droplet in micrometers. The mass or volume median diameter is the diameter of a droplet below or above which 50% of the total mass or volume of all spray droplets lie.

The flow rate of a spray is the amount of liquid discharged during a given period of time; it is normally identified with all factors that affect flow rate, such as pressure differential and liquid density. The penetration length is the maximum distance reached by a spray in stagnant air. Further, the penetration length is important for both steady and transient sprays. The penetration length is a constant for a steady spray. The penetration length varies with time for a transient spray. As described, sprays may be designed for a wide variety of applications by varying the many parameters discussed herein.

Fabric Treatment Fluids

Treatment fluids or adjuncts can vary widely and can be used at widely ranging levels. For example, detersive enzymes such as proteases, amylases, cellulases, lipases, and the like as well as bleach catalysts including the macrocyclic types having manganese or similar transition metals all useful in laundry and cleaning products can be used herein at very low, or less commonly, higher levels. Adjuncts that are catalytic, for example enzymes, can be used in "forward" or "reverse" modes, a discovery independently useful from the specific appliances of the present invention. For example, a lipolase or other hydrolase may be used, optionally in the presence of alcohols as adjuncts, to convert fatty acids to esters, thereby increasing their solubility in the lipophilic fluid. This is a "reverse" operation, in contrast with the normal use of this hydrolase in water to convert a less water-soluble fatty ester to a more water-soluble material. In any event, any adjunct must be suitable for use in combination with the present invention.

Some suitable adjuncts include, but are not limited to, builders, surfactants, enzymes, emulsifiers, bleach activators, bleach catalysts, bleach boosters, bleaches, alkalinity sources, antibacterial agents, colorants, perfumes, pro-perfumes, finishing aids, lime soap dispersants, composition malodor control agents, odor neutralizers, polymeric dye transfer inhibiting agents, crystal growth inhibitors, photobleaches, heavy metal ion sequestrants, anti-tarnishing agents, anti-microbial agents, anti-oxidants, anti-redeposition agents, soil release polymers, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, fabric-pressing starch, soil release polymers, soil repellency agents, sunscreen agents, anti-fade agents, waterproofing agents, stainproofing agents, and mixtures thereof.

The term "surfactant" conventionally refers to materials that are surface-active either in the water, lipophilic fluid, or the mixture of the two. Some illustrative surfactants include nonionic, cationic and silicone surfactants as used in conventional aqueous detergent systems. Suitable nonionic surfactants include, but are not limited to:

a) polyethylene oxide condensates of nonyl phenol and myristyl alcohol, such as in U.S. Pat. No. 4,685,930 Kasprzak; and b) fatty alcohol ethoxylates, $R—(OCH_2CH_2)_aOH$ a=1 to 100, typically 12–40, R=hydrocarbon residue 8 to 20 C atoms, typically linear alkyl. Examples polyoxyethylene lauryl ether, with 4 or 23 oxyethylene groups; polyoxyethylene cetyl ether with 2, 10 or 20 oxyethylene groups; polyoxyethylene stearyl ether, with 2, 10, 20, 21 or 100 oxyethylene groups; polyoxyethylene (2), (10) oleyl ether, with 2 or 10 oxyethylene groups. Commercially available examples include, but are not limited to: ALFONIC, BRU, GENAPOL, NEODOL, SURFONIC, TRYCOL. See also U.S. Pat. No. 6,013,683 Hill, et al.

Suitable cationic surfactants include, but are not limited to dialkyldimethylammonium salts having the formula:

$$R'R''N^+(CH_3)_2X^-$$

Where each R'R" is independently selected from the group consisting of 12–30 C atoms or derived from tallow, coconut oil or soy, X═Cl or Br, Examples include: didodecyldimethylammonium bromide (DDAB), dihexadecyldimethyl ammonium chloride, dihexadecyldimethyl ammonium bromide, dioctadecyldimethyl ammonium chloride, dieicosyldimethyl ammonium chloride, didocosyldimethyl ammonium chloride, dicoconutdimethyl ammonium chloride, ditallowdimethyl ammonium bromide (DTAB). Commercially available examples include, but are not limited to: ADOGEN, ARQUAD, TOMAH, VARIQUAT. See also U.S. Pat. No. 6,013,683 Hill et al.

Suitable silicone surfactants include, but are not limited to the polyalkyleneoxide polysiloxanes having a dimethyl polysiloxane hydrophobic moiety and one or more hydrophilic polyalkylene side chains and have the general formula:

$$R^1—(CH_3)_2SiO—[(CH_3)_2SiO]_a—[(CH_3)(R^1)SiO]_b—Si(CH_3)_2—R^1$$

wherein a+b are from about 1 to about 50, preferably from about 3 to about 30, more preferably from about 10 to about 25, and each $R^1$ is the same or different and is selected from the group consisting of methyl and a poly(ethyleneoxide/propyleneoxide) copolymer group having the general formula:

$$—(CH_2)_nO(C_2H_4O)_c(C_3H_6O)_dR^2$$

with at least one $R^1$ being a poly(ethyleneoxide/propyleneoxide) copolymer group, and wherein n is 3 or 4, preferably 3; total c (for all polyalkyleneoxy side groups) has a value of from 1 to about 100, preferably from about 6 to about 100; total d is from 0 to about 14, preferably from 0 to about 3; and more preferably d is 0; total c+d has a value of from about 5 to about 150, preferably from about 9 to about 100 and each $R^2$ is the same or different and is selected from the group consisting of hydrogen, an alkyl having 1 to 4 carbon atoms, and an acetyl group, preferably hydrogen and methyl group. Examples of these surfactants may be found in U.S. Pat. No. 5,705,562 Hill and U.S. Pat. No. 5,707,613 Hill.

Examples of this type of surfactants are the Silwet® surfactants which are available CK Witco, OSi Division, Danbury, Conn. Representative Silwet surfactants are as follows.

| Name | Average MW | Average a + b | Average total c |
|---|---|---|---|
| L-7608 | 600 | 1 | 9 |
| L-7607 | 1,000 | 2 | 17 |
| L-77 | 600 | 1 | 9 |
| L-7605 | 6,000 | 20 | 99 |
| L-7604 | 4,000 | 21 | 53 |
| L-7600 | 4,000 | 11 | 68 |
| L-7657 | 5,000 | 20 | 76 |
| L-7602 | 3,000 | 20 | 29 |

The molecular weight of the polyalkyleneoxy group ($R^1$) is less than or equal to about 10,000. Preferably, the molecular weight of the polyalkyleneoxy group is less than or equal to about 8,000, and most preferably ranges from about 300 to about 5,000. Thus, the values of c and d can be those numbers which provide molecular weights within these ranges. However, the number of ethyleneoxy units ($—C_2H_4O$) in the polyether chain ($R^1$) must be sufficient to render the polyalkyleneoxide polysiloxane water dispersible or water soluble. If propyleneoxy groups are present in the polyalkylenoxy chain, they can be distributed randomly in the chain or exist as blocks. Preferred Silwet surfactants are L-7600, L-7602, L-7604, L-7605, L-7657, and mixtures thereof. Besides surface activity, polyalkyleneoxide polysiloxane surfactants can also provide other benefits, such as antistatic benefits, and softness to fabrics.

The preparation of polyalkyleneoxide polysiloxanes is well known in the art. Polyalkyleneoxide polysiloxanes of the present invention can be prepared according to the procedure set forth in U.S. Pat. No. 3,299,112.

Another suitable silicone surfactant is SF-1488, which is available from GE silicone fluids.

These and other surfactants suitable for use in combination with the lipophilic fluid as adjuncts are well known in the art, being described in more detail in Kirk Othmer's Encyclopedia of Chemical Technology, 3rd Ed., Vol. 22, pp. 360–379, "Surfactants and Detersive Systems." Further suitable nonionic detergent surfactants are generally disclosed in U.S. Pat. No. 3,929,678, Laughlin et al., issued Dec. 30, 1975, at column 13, line 14 through column 16, line 6.

The adjunct may also be an antistatic agent. Any suitable well-known antistatic agents used in laundering and dry cleaning art are suitable for use in the methods and compositions of the present invention. Especially suitable as antistatic agents are the subset of fabric softeners which are known to provide antistatic benefits. For example those fabric softeners which have a fatty acyl group which has an iodine value of above 20, such as N,N-di(tallowoyl-oxyethyl)-N,N-dimethyl ammonium methylsulfate. However, it is to be understood that the term antistatic agent is not to be limited to just this subset of fabric softeners and includes all antistatic agents.

The adjunct may also be an emulsifier. Emulsifiers are well known in the chemical art. Essentially, an emulsifier acts to bring two or more insoluble or semi-soluble phases together to create a stable or semi-stable emulsion. It is preferred in the claimed invention that the emulsifier serves a dual purpose wherein it is capable of acting not only as an emulsifier but also as a treatment performance booster. For example, the emulsifier may also act as a surfactant thereby boosting cleaning performance. Both ordinary emulsifiers and emulsifier/surfactants are commercially available.

Lipophilic Fluid

The lipophilic fluid herein is one having a liquid phase present under operating conditions of a fabric article treating appliance, in other words, during treatment of a fabric article in accordance with the present invention. In general such a lipophilic fluid can be fully liquid at ambient temperature and pressure, can be an easily melted solid, e.g., one which becomes liquid at temperatures in the range from about 0 deg. C. to about 60 deg. C., or can comprise a mixture of liquid and vapor phases at ambient temperatures and pressures, e.g., at 25 deg. C. and 1 atm. pressure. Thus, the lipophilic fluid is not a compressible gas such as carbon dioxide.

It is preferred that the lipophilic fluids herein be nonflammable or have relatively high flash points and/or low VOC (volatile organic compound) characteristics, these terms having their conventional meanings as used in the dry cleaning industry, to equal or, preferably, exceed the characteristics of known conventional dry cleaning fluids.

Moreover, suitable lipophilic fluids herein are readily flowable and nonviscous.

In general, lipophilic fluids herein are required to be fluids capable of at least partially dissolving sebum or body soil as defined in the test hereinafter. Mixtures of lipophilic fluid are also suitable, and provided that the requirements of the Lipophilic Fluid Test, as described below, are met, the lipophilic fluid can include any fraction of dry-cleaning solvents, especially newer types including fluorinated solvents, or perfluorinated amines. Some perfluorinated amines such as perfluorotributylamines while unsuitable for use as lipophilic fluid may be present as one of many possible adjuncts present in the lipophilic fluid-containing composition.

Other suitable lipophilic fluids include, but are not limited to, diol solvent systems e.g., higher diols such as C6- or C8- or higher diols, organosilicone solvents including both cyclic and acyclic types, and the like, and mixtures thereof.

A preferred group of nonaqueous lipophilic fluids suitable for incorporation as a major component of the compositions of the present invention include low-volatility nonfluorinated organics, silicones, especially those other than amino functional silicones, and mixtures thereof. Low volatility nonfluorinated organics include for example OLEAN® and other polyol esters, or certain relatively nonvolatile biodegradable mid-chain branched petroleum fractions.

Another preferred group of nonaqueous lipophilic fluids suitable for incorporation as a major component of the compositions of the present invention include, but are not limited to, glycol ethers, for example propylene glycol methyl ether, propylene glycol n-propyl ether, propylene glycol t-butyl ether, propylene glycol n-butyl ether, dipropylene glycol methyl ether, dipropylene glycol n-propyl ether, dipropylene glycol t-butyl ether, dipropylene glycol n-butyl ether, tripropylene glycol methyl ether, tripropylene glycol n-propyl ether, tripropylene glycol t-butyl ether, tripropylene glycol n-butyl ether. Suitable silicones for use as a major component, e.g., more than 50%, of the composition include cyclopentasiloxanes, sometimes termed "D5", and/or linear analogs having approximately similar volatility, optionally complemented by other compatible silicones. Suitable silicones are well known in the literature, see, for example, Kirk Othmer's Encyclopedia of Chemical Technology, and are available from a number of commercial sources, including General Electric, Toshiba Silicone, Bayer, and Dow Corning. Other suitable lipophilic fluids are commercially available from Procter & Gamble or from Dow Chemical and other suppliers.

Qualification of Lipophilic Fluid and Lipophilic Fluid Test (LF Test)

Any nonaqueous fluid that is both capable of meeting known requirements for a dry-cleaning fluid (e.g, flash point etc.) and is capable of at least partially dissolving sebum, as indicated by the test method described below, is suitable as a lipophilic fluid herein. As a general guideline, perfluorobutylamine (Fluorinert FC-43®) on its own (with or without adjuncts) is a reference material which by definition is unsuitable as a lipophilic fluid for use herein (it is essentially a nonsolvent) while cyclopentasiloxanes have suitable sebum-dissolving properties and dissolves sebum.

The following is the method for investigating and qualifying other materials, e.g., other low-viscosity, free-flowing silicones, for use as the lipophilic fluid. The method uses commercially available Crisco® canola oil, oleic acid (95% pure, available from Sigma Aldrich Co.) and squalene (99% pure, available from J.T. Baker) as model soils for sebum. The test materials should be substantially anhydrous and free from any added adjuncts, or other materials during evaluation.

Prepare three vials, each vial will contain one type of lipophilic soil. Place 1.0 g of canola oil in the first; in a second vial place 1.0 g of the oleic acid (95%), and in a third and final vial place 1.0 g of the squalene (99.9%). To each vial add 1 g of the fluid to be tested for lipophilicity. Separately mix at room temperature and pressure each vial containing the lipophilic soil and the fluid to be tested for 20 seconds on a standard vortex mixer at maximum setting. Place vials on the bench and allow to settle for 15 minutes at room temperature and pressure. If, upon standing, a clear single phase is formed in any of the vials containing lipophilic soils, then the nonaqueous fluid qualifies as suitable for use as a "lipophilic fluid" in accordance with the present invention. However, if two or more separate layers are formed in all three vials, then the amount of nonaqueous fluid dissolved in the oil phase will need to be further determined before rejecting or accepting the nonaqueous fluid as qualified.

In such a case, with a syringe, carefully extract a 200-microliter sample from each layer in each vial. The syringe-extracted layer samples are placed in GC auto sampler vials and subjected to conventional GC analysis after determining the retention time of calibration samples of each of the three models soils and the fluid being tested. If more than 1% of the test fluid by GC, preferably greater, is found to be present in any one of the layers which consists of the oleic acid, canola oil or squalene layer, then the test fluid is also qualified for use as a lipophilic fluid. If needed, the method can be further calibrated using heptacosafluorotributylamine, i.e., Fluorinert FC-43 (fail) and cyclopentasiloxane (pass). A suitable GC is a Hewlett Packard Gas Chromatograph HP5890 Series II equipped with a split/splitless injector and FID. A suitable column used in determining the amount of lipophilic fluid present is a J&W Scientific capillary column DB-1HT, 30 meter, 0.25 mm id, 0.1 um film thickness cat# 1221131. The GC is suitably operated under the following conditions:

Carrier Gas: Hydrogen
Column Head Pressure: 9 psi
Flows: Column Flow @~1.5 ml/min.
Split Vent @~250–500 ml/min.
Septum Purge @ 1 ml/min.
Injection: HP 7673 Autosampler, 10 ul syringe, 1 ul injection
Injector Temperature: 350° C.
Detector Temperature: 380° C.
Oven Temperature Program: initial 60° C. hold 1 min.
rate 25° C./min.
final 380° C. hold 30 min.

Preferred lipophilic fluids suitable for use herein can further be qualified for use on the basis of having an excellent garment care profile. Garment care profile testing is well known in the art and involves testing a fluid to be qualified using a wide range of garment or fabric article components, including fabrics, threads and elastics used in seams, etc., and a range of buttons. Preferred lipophilic fluids for use herein have an excellent garment care profile, for example they have a good shrinkage and/or fabric puckering profile and do not appreciably damage plastic buttons. Certain materials which in sebum removal qualify for use as lipophilic fluids, for example ethyl lactate, can be quite objectionable in their tendency to dissolve buttons, and if such a material is to be used in the compositions of the present invention, it will be formulated with water and/or other solvents such that the overall mix is not substantially damaging to buttons. Other lipophilic fluids, D5, for example, meet the garment care requirements quite admirably. Some suitable lipophilic fluids may be found in granted U.S. Pat. Nos. 5,865,852; 5,942,007; 6,042,617; 6,042,618; 6,056,789; 6,059,845; and 6,063,135, which are incorporated herein by reference.

Lipophilic fluids can include linear and cyclic polysiloxanes, hydrocarbons and chlorinated hydrocarbons, with the exception of PERC which is explicitly not covered by the lipophilic fluid definition as used herein. (Specifically call out DF2000 and PERC). More preferred are the linear and cyclic polysiloxanes and hydrocarbons of the glycol ether, acetate ester, lactate ester families. Preferred lipophilic fluids include cyclic siloxanes having a boiling point at 760 mm Hg. of below about 250° C. Specifically preferred cyclic siloxanes for use in this invention are octamethylcyclotetrasiloxane, decamethylcyclopentasiloxane, and dodecamethylcyclohexasiloxane. Preferably, the cyclic siloxane comprises—decamethylcyclopentasiloxane (D5, pentamer) and is substantially free of octamethylcyclotetrasiloxane (tetramer) and dodecamethylcyclohexasiloxane (hexamer).

However, it should be understood that useful cyclic siloxane mixtures might contain, in addition to the preferred cyclic siloxanes, minor amounts of other cyclic siloxanes including octamethylcyclotetrasiloxane and hexamethylcyclotrisiloxane or higher cyclics such as tetradecamethylcycloheptasiloxane. Generally the amount of these other cyclic siloxanes in useful cyclic siloxane mixtures will be less than about 10 percent based on the total weight of the mixture. The industry standard for cyclic siloxane mixtures is that such mixtures comprise less than about 1% by weight of the mixture of octamethylcyclotetrasiloxane.

Accordingly, the lipophilic fluid of the present invention preferably comprises more than about 50%, more preferably more than about 75%, even more preferably at least about 90%, most preferably at least about 95% by weight of the lipophilic fluid of decamethylcyclopentasiloxane. Alternatively, the lipophilic fluid may comprise siloxanes which are a mixture of cyclic siloxanes having more than about 50%, preferably more than about 75%, more preferably at least about 90%, most preferably at least about 95% up to about 100% by weight of the mixture of decamethylcyclopentasiloxane and less than about 10%, preferably less than about 5%, more preferably less than about 2%, even more preferably less than about 1%, most preferably less than about 0.5% to about 0% by weight of the mixture of octamethylcyclotetrasiloxane and/or dodecamethylcyclohexasiloxane.

The level of lipophilic fluid, when present in the lipophilic fluid based fabric treating compositions according to the present invention, is preferably from about 70% to about 99.99%, more preferably from about 90% to about 99.9%, and even more preferably from about 95% to about 99.8% by weight of the lipophilic fluid based fabric treating composition.

Emulsion

Some lipophilic and/or treatment fluids may require at least some water to operate effectively and/or remove hydrophilic soils. In order to minimize harm to the fabrics, an emulsion may be formed using water, the lipophilic and/or treatment fluid, and, optionally, an emulsifying agent. Further, not intending to be bound by theory, the water may also function as a carrier and/or activator for treatment fluids that are not very effective in the lipophilic fluid alone. This water may be added at any point and/or in any sequence in the treatment process or may be mixed with the lipophilic and/or treatment fluid prior to application to the fabrics.

Automation

The present invention is preferably automated such that the application of the treatment fluid automatically occurs only while the fabric load is in motion. In this respect, the application device is linked to the chamber or chamber motor in the apparatus such that the application device does not operate while the chamber is not in motion. Further, the application device may be linked into an apparatus control device such that custom spray/tumble cycles can be carried out. The spray device can also be linked to a fabric load size indicator such that the total volume of each treatment fluid to be applied and/or the total time of application can be determined before or while the application process occurs. An example of how one programmable logic controller can be utilized to carry out the application methods of the instant invention is shown in FIG. 1 and described below.

Auto-Spray Operational Description

| Line # | Component Description | Component Purpose |
|---|---|---|
| 10 | Programmable Logic Controller (PLC) | Monitors state of dry-cleaning (DC) machine and control spray via solenoids and pump |
| 20 | Load Controller | Determines spray parameters (time/volume) according to load size (input by operator in this case) |
| 30 | DC Machine Relays (R1 & R2) | Enable signals instructing drum to rotate bi-directionally (clockwise and counter-clockwise) |
| 40 | DC Machine Drum | Rotates bi-directionally to reposition fabric articles |
| 50 | Spray Nozzle(s) | Sprays fluid into drum only while drum is rotating |
| 60 | Fluid Reservoir | Stores treatment fluid to be sprayed into DC drum (can have more than one reservoir for multiple treatment fluids) |
| 70 | Fluid Pump | Pumps treatment fluid from Reservoir to DC drum |
| 80 | Solenoid Valves (V1 & V2) | Open and close fluid and air passages to keep spray system primed and facilitate optional supply line and nozzle clean-out |
| 90 | Air Pressure Gauge | Indicates air pressure |
| 100 | Air Pressure Regulator | Regulates air pressure |
| 110 | Air Supply | Supplies air pressure |
| 120 | DC Machine Operator Panel | Houses buttons/indicators that activate various components during program steps (auto or manual) |
| 130 | DC Machine | Dry Cleaning Machine |
| 140 | Spray Cycle Relay (R0) | New relay to distinguish spray cycle from all others controlled by the PLC |

Sequence of operations:

1. Operator inputs load size (lbs.) into Load Controller and starts DC program. May also have a load size indicator connected to the Load Controller or the PLC such that no operator input is necessary for load size.
2. When DC gets to spray cycle in program, the RO relay, in conjunction with R1 or R2, will enable the PLC to start its program.
3. The PLC synchronizes the rotation of the drum with the spraying of fluid by monitoring R1 and R2. When R1 and R2 are active, the PLC energizes the valves and pump to spray, purge, and keep the system primed.
4. The Load Controller provides an input to the PLC that tells the PLC how long to continue following the cycling of R1 & R2. This in turn determines duration, and therefore volume, of fluid being sprayed according to load size.
5. Optionally, the treatment fluid supply line between V1, V2, and the spray nozzle(s) can be purged by closing V1 such that air purges the treatment fluid supply line and the spray nozzle(s). This optional procedure cleans out the treatment fluid supply line for future use or just prior to the application of another treatment fluid.

From the example above, one skilled in the art should understand how to modify an apparatus, in this case a dry cleaning machine, to carry out the methods of the instant invention. By building a new door inset designed to accommodate the nozzle and replace the existing "window," the nozzle in this example is placed in the chamber door's "window." A skilled artisan could easily install plumbing, fluid supply reservoirs, and valves if they are not already within in the machine.

An apparatus for use with the instant invention can be built or modified in any number of ways apparent to the skilled artisan provided it is capable of applying a treatment fluid onto fabrics in a chamber-bearing fabric treatment apparatus by spraying a treatment fluid spray into the apparatus and onto the fabrics only while the fabrics are in motion. It is important to the invention that when there is no motion, there is no spraying. This is one mechanism that keeps the fabrics from becoming point saturated. That is, if a fabric article were to sit motionless in front of the spray outlet during treatment fluid spraying, it would undesirably become saturated in only one area. The fact that other articles within the same load remain barely, if at all, contacted by the treatment fluid complicates matters further.

Preferably, the drum motion is rotational motion at less than about 1 G such that the fabrics are "tumbled" rather than "spun." Also preferred is drum motion that includes a period of clockwise rotational motion, and a period of counterclockwise rotational motion. The two directions of rotational motion can occur either separately, as in an ordinary laundering apparatus, or simultaneously, as in a contra-rotation machine. It is also preferred that the clockwise rotational motion lasts at least about 5 seconds, preferably at least about 5 seconds and at most about 20 seconds, the counterclockwise rotational motion lasts at least about 5 seconds, preferably at least about 5 seconds and at most about 20 seconds, and the motionless period, wherein no spraying occurs, lasts at least about 1 second, preferably at least about 1 second and at most about 5 seconds.

In a manual version of the instant invention, an operator would activate the spray to spray treatment fluid only when the fabrics are tumbling and would monitor the treatment fluid application cycle in its entirety. However, in order to reduce manual labor and the costs associated therewith, it is preferable that the spraying is synchronized with the chamber or the chamber's rotation providing motor such that spraying is automatically ceased during periods of no rotation. Once chamber motion and/or the motor ceases, a signal can be sent to close a treatment fluid supply valve, disable the applicator, or both.

Some treatment fluids may be expensive and must be used in calculated amounts so as not to defeat the cost effectiveness of the treatment. Other treatment fluids may be undesirable in excess amounts regardless of cost. Therefore, in order to determine the proper volume of total treatment fluid to be sprayed, a machine operator would calculate the total amount of fluid to be sprayed based on the weight or the size of the fabric load and the selected treatment fluid. Further, the operator would design a tumble regime to spray the necessary volume of treatment fluid at a given flow rate only while said fabrics are tumbling. In the alternative, the operator could vary the spray flow rate to accommodate a fixed tumble regime. The process can become quite complicated particularly when multiple treatment fluids, in series or in combination, must be applied during the treatment fluid application cycle.

Therefore, it is preferable to automate the apparatus by adding a fabric load size indicator if one is not already there. The fabric size load indicator will automatically determine the total volume of treatment fluid to be applied to the particular fabric load and can be selected from an operator input panel and/or a fabric load scale. The operator input panel will allow for selection of the load size in qualitative measures like small, medium, large, etc., or in quantitative measure such as the number of pounds. Obviously, the fabric load scale will weigh the fabric load and provide a weight measure directly to the Programmable Logic Controller. In either scenario, the Programmable Logic Controller will convert the fabric load size to a total volume of treatment fluid via a straight conversion using a treatment fluid to fabric coefficient or by way of an algorithm.

As discussed in the "Application" subsection hereinbefore, spray parameters can vary in many ways. One preferable spray parameter relates to the spray penetration length being less than about the distance from the point of spray origination to the farthest chamber wall. As such, a majority of the spray droplets will not end up on the chamber walls; rather, they will dissipate and commingle with the fabric articles. In the example above, wherein a spray nozzle is mounted in the door, the spray penetration length will be equal to or less than the distance from the nozzle's outlet to the back of the horizontal drum.

The penetration length can be easily measured for many sprays and can likewise be easily altered. The fabric-containing chamber can be likened to a three-dimensional geometric shape; in the case of laundering apparatus, it is typically a hollow cylinder. In order to ascertain the desired spray penetration length, one would simply measure the distance from the planned site of the spray applicator and the farthest chamber wall in the applicator's spraying line. The spray penetration length is a function of the applicator(s) selected, treatment fluid density and/or viscosity, treatment fluid supply pressure, and inter-chamber gas sheer forces. The spray penetration length is easily alterable by a skilled artisan.

Another preferred parameter is a treatment fluid spray with a median droplet size of from about 1 micron to about 300 microns, more preferably 5 microns to about 300 microns, and most preferably about 5 microns to about 50 microns. One preferable spray creation method is to utilize a gas assist nozzle and a gas to convert the treatment fluid into the treatment fluid spray. It is preferred that the gas assist nozzle is operated at a pressure from about 5 psi to about 80 psi, more preferably from about 20 psi to about 30 psi. The most preferred gases are nitrogen, air, steam, and combinations thereof.

Another preferable spray creation method is to utilize a pressure atomizer to convert the treatment fluid into the treatment fluid spray. Pressure atomizers are discussed in the "Application" subsection herein. A third preferred spray creation method is a high volume ultrasonic atomizer.

Suitable treatment fluids for use with the present invention, in addition to those discussed in the "Treatment Fluids" subsection herein, include perfumes, enzymes, bleaches, surfactants, emulsifiers, fabric softeners, antibacterial agents, antistatic agents, brighteners, dye fixatives, dye abrasion inhibitors, anti-crocking agents, wrinkle reduction agents, wrinkle resistance agents, soil release polymers, sunscreen agents, anti-fade agents, waterproofing agents, stainproofing agents, soil repellency agents, and mixtures thereof.

The present invention is also directed to an apparatus capable of carrying out at least all of the methods described above. The apparatus should apply a treatment fluid onto fabrics by spraying a treatment fluid spray into the apparatus only while the fabrics are in motion. The apparatus includes, at minimum, at least one chamber for containing the fabrics, at least one chamber rotation providing motor mechanically connected to the chamber such that it is capable of providing rotational motion to the chamber, at least one applicator for converting the treatment fluid into the treatment fluid spray and mounted in the apparatus such that it is capable of delivering treatment fluid spray into the chamber, at least one treatment fluid supply for containing the treatment fluid and connected to the applicator by at least one treatment fluid conduit such that it is capable of supplying treatment fluid to the applicator for conversion to the treatment fluid spray, and at least one synchronization element to synchronize spraying with the chamber motion or the chamber rotation-providing motor in the apparatus which is electronically or mechanically connected to the chamber or chamber rotation providing motor such that it is capable of actuating and stopping the applicator in order to automatically stop treatment fluid spraying during periods of no chamber motion.

As in the method, the apparatus preferably includes a fabric load indicator to determine the total amount of treatment fluid to be sprayed. This is preferably an element selected from the group including a weight scale, a load controller, operator input, and combinations thereof. The methods to utilize a fabric load size indicator are as discussed above.

As in the method, the apparatus' synchronization is preferably automatic such that manual labor is minimized. Preferably, the synchronization capability includes an element selected from the group consisting of a Programmable Logic Controller and/or a rotational motion indicator connected to either the chamber or chamber rotation providing motor. The synchronization methods are carried out as discussed above.

Preferable applicators include pressure atomizers, gas assist nozzles, and ultrasonic atomizers. If a gas assist nozzle is selected, the apparatus will further comprise at least one gas conduit and at least one gas supply. The gas conduit connects the gas supply to the applicator such that gas can be transported to the applicator in order to assist in atomizing the treatment fluid and propel the treatment fluid spray into the chamber. The gas conduit can be any fluid line suitable for transporting pressurized gas and can be selected by a skilled artisan. The gas supply can either be a typical "tank type" of supply or can be generated in the apparatus. Air compressors and Nitrogen and steam generation units are well known in the industry. If a gas assist nozzle is utilized, it is preferable the gas conduit be operated at a pressure from about 5 psi to about 80 psi, more preferably from about 20 psi to about 30 psi.

It will be understood that the present invention may be combined with other fabric treatments. For example, prior to treating, the fabric articles may be subjected to the particulate removal method described in co-pending application Ser. No. 60/191,965, to Noyes et al., filed Mar. 24, 2000.

The present invention may be used in a service, such as a dry cleaning service, diaper service, uniform cleaning service, or commercial business, such as a laundromat, dry cleaner, linen service which is part of a hotel, restaurant, convention center, airport, cruise ship, port facility, casino, or may be used in the home.

The present invention may also be performed in an apparatus having a "contra-rotating" drum. A contra-rotating drum is a two-piece split drum wherein each half of the drum is capable of rotation in a direction opposite the other half of the drum simultaneously. The contra-rotating movement is an effective mechanism for randomly rearranging the fabric articles' positions within the drum. These apparatus are commercially available from companies such as Dyson.

The present invention may also be performed in an apparatus capable of "dual mode" functions. A "dual mode" apparatus is one capable of both washing and drying fabrics within the same chamber. These apparatus are widely available, especially in Europe.

The present invention may be performed in an apparatus that is a modified existing apparatus and is retrofitted in such a manner as to conduct the process of the present invention in addition to related processes.

Finally, the present invention may also be performed in an apparatus, which is not a modified existing apparatus but is one specifically built in such a manner so as to conduct the process of the present invention. This would include all the associated plumbing, such as connection to a chemical and/or water supply, and sewerage for waste fluids.

An apparatus used in the processes of the present invention will typically contain some type of control system. These include electrical systems, such as, the so-called smart control systems, as well as more traditional electromechanical systems. The control systems would enable the user to select the size of the fabric load to be treated, the type of treatment, and the time for the treatment cycle. Alternatively, the user could use pre-set treatment cycles, or the apparatus could control the length of the cycle, based on any number of ascertainable parameters. This would be especially true for electrical control systems.

In the case of electrical control systems, one option is to make the control device a so-called "smart device". This could mean including, but not limited to, self diagnostic system, load type and cycle selection, linking the machine to the Internet and allowing for the consumer to start the apparatus remotely, be informed when the apparatus has treated a fabric article, or for the supplier to remotely diagnose problems if the apparatus should break down. Furthermore, if the apparatus of the present invention is only a part of a cleaning system, the so called "smart system" could be communicating with the other cleaning devices which would be used to complete the remainder of the cleaning process, such as a washing machine, and a dryer.

What is claimed is:

1. A fabric treating apparatus comprising:

a. a chamber for receiving a plurality of fabric articles to be treated;

b. a motion provider configured to provide rotational motion to the chamber;

c. an applicator configured to apply a fabric treatment fluid into the chamber;

d. a programmable logic controller;

e. at least one machine relay operatively associated with the controller and the motion provider; and f. a spray cycle relay operatively associated with the controller and the applicator;

wherein the chamber exhibits a period of clockwise rotational motion, a period of counterclockwise rotational motion and a period of no motion which occurs at a period of transition between the two periods of rotational motion; wherein the controller and the relays are configured to make the motion provider and the applicator active at the same time such that the applicator applies the fabric treatment fluid into the chamber when and only when the chamber is in motion.

2. The apparatus of claim 1 further comprising a fabric load size sensor configured to determine the load size of the plurality of fabric articles received by the chamber such that the total volume of the fabric treatment fluid to be applied to the plurality of fabric articles can be determined.

3. The apparatus of claim 2 wherein the fabric load size sensor being selected from the group consisting of a weight scale, a load controller, operator input and combinations thereof.

4. The apparatus of claim 1 wherein the applicator is a pressure atomizer configured to convert the fabric treatment fluid into the form of a spray or a mist.

5. The apparatus of claim 1 wherein the applicator is a gas assist nozzle connected via a gas conduit to at least one gas supply.

6. The apparatus of claim 5 wherein the gas conduit operates at a pressure from about 5 psi to about 80 psi.

7. The apparatus of claim 6 wherein the gas conduit operates at a pressure from about 20 psi to about 30 psi.

8. The apparatus of claim 5 wherein the gas supply provides a gas selected from the group consisting of nitrogen, air, steam, and combinations thereof.

9. The apparatus of claim 1 wherein the fabric treatment fluid is applied in the form of a spray having a median droplet size of from about 5 microns to about 300 microns.

10. The apparatus of claim 1 wherein the fabric treatment fluid is applied in the form of a spray having a median droplet size of from about 5 microns to about 50 microns.

11. The apparatus according to claim 1 wherein the rotational motion is at less than about 1 G.

12. The apparatus according to claim 1 wherein the period of clockwise rotational motion lasts at least about 5 seconds, the period of counterclockwise rotational motion lasts at least about 5 seconds, and the period of no motion lasts at least about 1 second.

13. The apparatus according to claim 1 wherein the period of clockwise rotational motion lasts from about 5 seconds to about 20 seconds, the a period of counterclockwise rotational motion lasts from about 5 seconds to about 20 seconds, and the period of no motion lasts from about 1 second to about 5 seconds.

14. The apparatus according to claim 1 wherein the motion of the plurality of fabric articles results from motion of the chamber.

15. The apparatus according to claim 1 wherein the chamber is capable of countra-rotation.

* * * * *